US006239550B1

(12) United States Patent
Maeda

(10) Patent No.: US 6,239,550 B1
(45) Date of Patent: May 29, 2001

(54) TUNGSTEN HALOGEN LAMP WITH INFRARED REFLECTING FILM AND METHOD FOR MANUFACTURING THE SAME

(75) Inventor: Kazuo Maeda, Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/119,795

(22) Filed: Jul. 21, 1998

(30) Foreign Application Priority Data

Jul. 30, 1997 (JP) ..... 9-204120

(51) Int. Cl.[7] ..... H01K 1/50

(52) U.S. Cl. ..... 313/579; 313/623; 313/580; 313/112; 445/58

(58) Field of Search ..... 445/58; 313/112, 313/113, 579, 569, 570, 315, 331, 332

(56) References Cited

U.S. PATENT DOCUMENTS

| | | | | |
|---|---|---|---|---|
| 3,420,944 | | 1/1969 | Holcomb | 313/318.12 |
| 3,753,026 | * | 8/1973 | Goorissen | 313/332 |
| 3,793,615 | | 2/1974 | Homonnay et al. | 313/331 |
| 4,810,932 | | 3/1989 | Ahlgren et al. | 313/579 |
| 4,835,439 | * | 5/1989 | Essock et al. | 313/332 |
| 4,983,001 | * | 1/1991 | Hagiuda et al. | 313/112 |
| 5,045,748 | | 9/1991 | Ahlgren et al. | 313/113 |
| 5,138,219 | | 8/1992 | Krisl et al. | 313/112 |
| 5,402,038 | * | 3/1995 | Parham et al. | 313/331 |
| 5,506,471 | * | 4/1996 | Kosmatkka et al. | 313/112 |
| 5,550,423 | * | 8/1996 | Oughton | 313/112 |
| 5,627,426 | * | 5/1997 | Whitman et al. | 313/112 |

FOREIGN PATENT DOCUMENTS

| | | |
|---|---|---|
| 0 492 189 | 7/1992 | (EP) . |
| 56-128543 | 10/1981 | (JP) . |
| 57-74963 | 5/1982 | (JP) . |
| 63-289755 | 11/1988 | (JP) . |
| 1-251550 | 10/1989 | (JP) . |
| 1-251553 | 10/1989 | (JP) . |
| 3-226958 | 10/1991 | (JP) . |
| 7-130336 | 5/1995 | (JP) . |

OTHER PUBLICATIONS

Mar. 2, 1999, Communication from European Patent Office and attached Search Report.

* cited by examiner

*Primary Examiner*—Ashok Patel
*Assistant Examiner*—Mariceli Santiago
(74) *Attorney, Agent, or Firm*—Merchant & Gould P.C.

(57) ABSTRACT

A tungsten halogen lamp comprises an arc tube of fused quartz having a sealing portion at one end with a halogen element and a rare gas enclosed and a filament coil held within the arc tube, and an infrared reflecting film is formed on the surface of the arc tube. The sealing portion seals metal foils connected to the filament coil and outer leads having one end connected to the metal foils and the other end led out of the sealing portion. The infrared reflecting film is formed on the surfaces of the outer leads and the surfaces of the metal foils, and at least a part of the surface of the sealing portion has a portion where the infrared reflecting film is not formed or a portion where at least a part of the infrared reflecting film is removed. Therefore, the oxidation of the metal foils is prevented, and a tungsten halogen lamp that has a long life and a high efficiency and is inexpensive and a method for manufacturing the same are obtained.

8 Claims, 6 Drawing Sheets

TUNGSTEN HALOGEN LAMP WITH INFRARED REFLECTING FILM AND METHOD FOR MANUFACTURING THE SAME

FIELD OF THE INVENTION

The present invention relates to a tungsten halogen lamp in which an infrared reflecting film is formed and to a method for manufacturing the same.

BACKGROUND OF THE INVENTION

A single-end-sealed tungsten halogen lamp 17 as shown in FIG. 5 is known as a conventional tungsten halogen lamp (Japanese Patent Application No. (Tokkai Sho) 57-74963). In the tungsten halogen lamp 17, an infrared reflecting film 16 is formed on the surface of a straight-tube-shaped arc tube 15, in which a filament coil 14 is located, by alternately dipping the arc tube 15 in a solution for forming a $TiO_2$ film and a solution for forming a $SiO_2$ film.

In the conventional tungsten halogen lamp, gaps 18 that are not hermetically sealed occur between the quartz glass of a sealing portion 19 and metal foils 20 and outer leads 21, along parts of the metal foils 20 of molybdenum sealed in the sealing portion 19, and along the outer leads 21 having one end connected to the metal foils 20 and the other end led out of the sealing portion 19.

When the gaps 18 are present, air enters into the sealing portion 19 through the gaps 18, so that the metal foils 20 in the sealing portion 19 are oxidized during the lamp life. Therefore, leaks and cracks are eventually caused in the sealing portion 19, shortening the lamp life. In addition, the lamp efficiency of the tungsten halogen lamp increases only by about 7% by forming the infrared reflecting film 16.

Another conventional tungsten halogen lamp as shown in FIG. 6 is known (U.S. Pat. Nos 5,045,748 and 5,138,219). The tungsten halogen lamp comprises a double-end-sealed elliptical arc tube 22 of fused quartz in an outer tube 24. An infrared reflecting film 23 is formed on the surface of the arc tube 22 by a CVD technique (chemical vapor deposition technique). With the CVD technique, the arc tube 22 is put into an evacuated furnace, and tantalum (Ta) and silicon (Si) atmospheres are created alternately in the furnace.

The luminous efficiency of this conventional tungsten halogen lamp increases by about 50% because of the infrared reflecting film 23 and the elliptical arc tube 22. However, since the tungsten halogen lamp has a double-tube structure in which the arc tube 22 is held in the outer tube 24, the structure is complicated and involves a high cost.

In order to solve the above problems, it is an object of the present invention to provide a tungsten halogen lamp that has a long life and a high efficiency and is inexpensive, and a method for manufacturing the same, by preventing the oxidation of the metal foils.

SUMMARY OF THE INVENTION

It is an object of the present invention to provide a tungsten halogen lamp comprising an arc tube of fused quartz having a sealing portion at one end with a halogen element and a rare gas enclosed and a filament coil held within the arc tube, an infrared reflecting film being formed on the surface of the arc tube, the sealing portion sealing metal foils connected to the filament coil and outer leads having one end connected to the metal foils and the other end led out of the sealing portion. The infrared reflecting film is formed on the surfaces of the outer leads and the surfaces of the metal foils, and at least a part of the surface of the sealing portion has a portion where the infrared reflecting film is not formed and/or a portion where at least a part of the infrared reflecting film is removed.

In the tungsten halogen lamp, the "at least a part" of the surface of the sealing portion refers to 20 to 100% of the surface of the sealing portion. The "at least a part of" the infrared reflecting film refers to 20 to 100% of the thickness of the formed infrared reflecting film.

It is preferable that the infrared reflecting film formed on the surface of the arc tube is a multilayer interference film in which layers of a high refractive material and layers of a low refractive material are alternately laminated and that the layer of a high refractive material is made of at least one material selected from the group consisting of $Ta_2O_5$, $Nb_2O_5$, $CeO_2$, SiC, ZnS, $TiO_2$, $Si_3N_4$, $Y_{2O3}$, and $ZrO_2$. Also, it is preferable that the layer of a low refractive material is made of at least one material selected from the group consisting of $MgF_2$, $SiO_2$, and $Al_2O_3$.

It is preferable that the total thickness of the infrared reflecting film formed on the surface of the arc tube is in the range of 0.8 to 3.5 $\mu$m.

It is preferable that the thickness of the infrared reflecting film formed on the surfaces of the outer leads and the surfaces of the metal foils is in the range of 0.8 to 3.5 $\mu$m.

It is preferable that at least a part of the arc tube has a swelling portion, and the filament coil is held on the central axis of the swelling portion.

It is preferable that the swelling portion has an elliptical shape.

The present invention provides a method for manufacturing a tungsten halogen lamp, the tungsten halogen lamp comprising an arc tube of fused quartz having a sealing portion at one end with a halogen element and a rare gas enclosed and a filament coil held within the arc tube, an infrared reflecting film being formed on the surface of the arc tube, the sealing portion sealing metal foils connected to the filament coil and outer leads having one end connected to the metal foils and the other end led out of the sealing portion. The method comprises the steps of forming the infrared reflecting film on the surface of the arc tube, the surfaces of the outer leads, the surfaces of the metal foils, and the surface of the sealing portion, and removing at least a part of the infrared reflecting film formed on the surface of the sealing portion.

In the method, it is preferable that the infrared reflecting film is formed by a chemical vapor deposition technique.

In the method, it is preferable that the infrared reflecting film is formed by dipping.

In the method, it is preferable that the infrared reflecting film formed on the surface of the sealing portion is removed by sand blasting.

According to the present invention, the temperature of the sealing portion can be decreased while the lamp is turned on. Furthermore, the outer leads and the metal foils exposed to the air in the gaps in the sealing portion can be shielded and protected from the oxygen in the air by the infrared reflecting film. Therefore, the oxidation of the metal foils can be avoided during the lamp life.

The present invention provides a method for manufacturing a tungsten halogen lamp, the tungsten halogen lamp comprising an arc tube of fused quartz having a sealing portion at one end with a halogen element and a rare gas enclosed and a filament coil held within the arc tube, an infrared reflecting film being formed on the surface of the arc tube, the sealing portion sealing metal foils connected to the filament coil and outer leads having one end connected to the metal foils and the other end led out of the sealing portion. The infrared reflecting film is formed on the surfaces of the outer leads and the surfaces of the metal foils exposed to gaps that are not hermetically sealed in the sealing portion, a portion where the infrared reflecting film is not formed being defined on the surface of the sealing portion. The method comprises the steps of forming the infrared reflecting film on the surface of the arc tube and removing the infrared reflecting film formed on the surface of the sealing portion.

Accordingly, a tungsten halogen lamp that can prevent the oxidation of the metal foils during the lamp life can be obtained.

DETAILED DESCRIPTION OF THE INVENTION

Preferred embodiments of the present invention will be described below with reference to the drawings.

Figure 1:
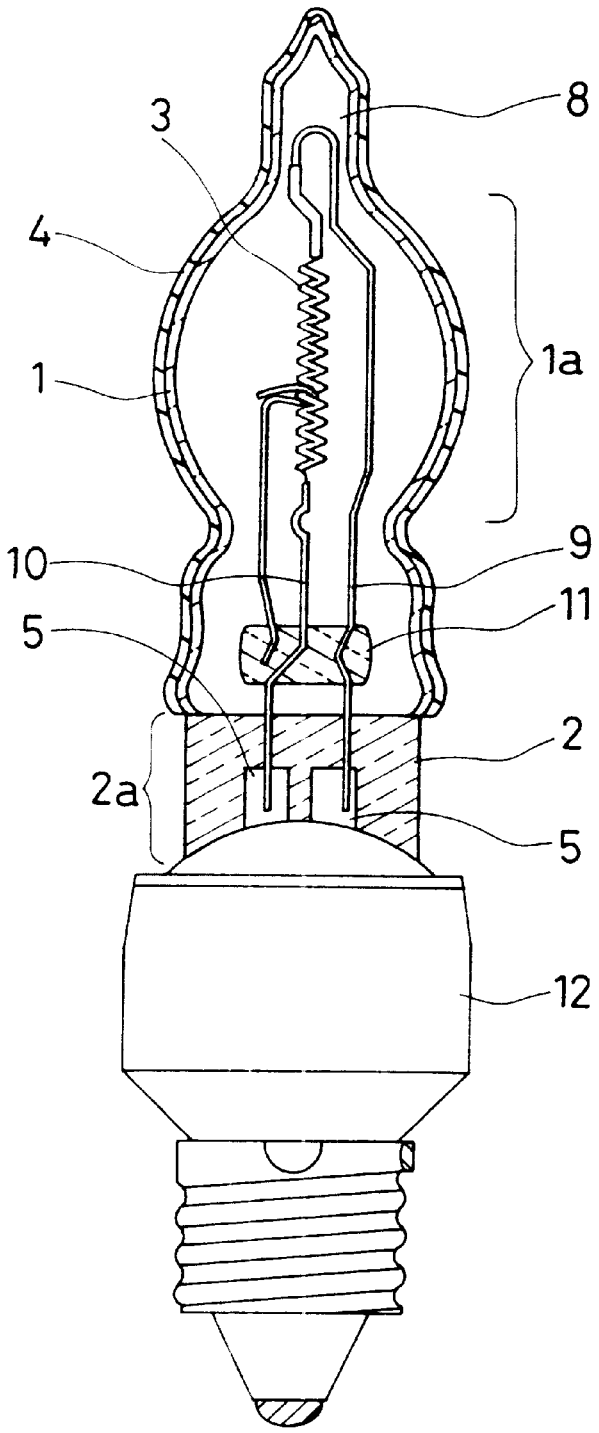
FIG. 1 is a partially cross-sectional view of a tungsten halogen lamp in an embodiment of the present invention.
Figure 2:
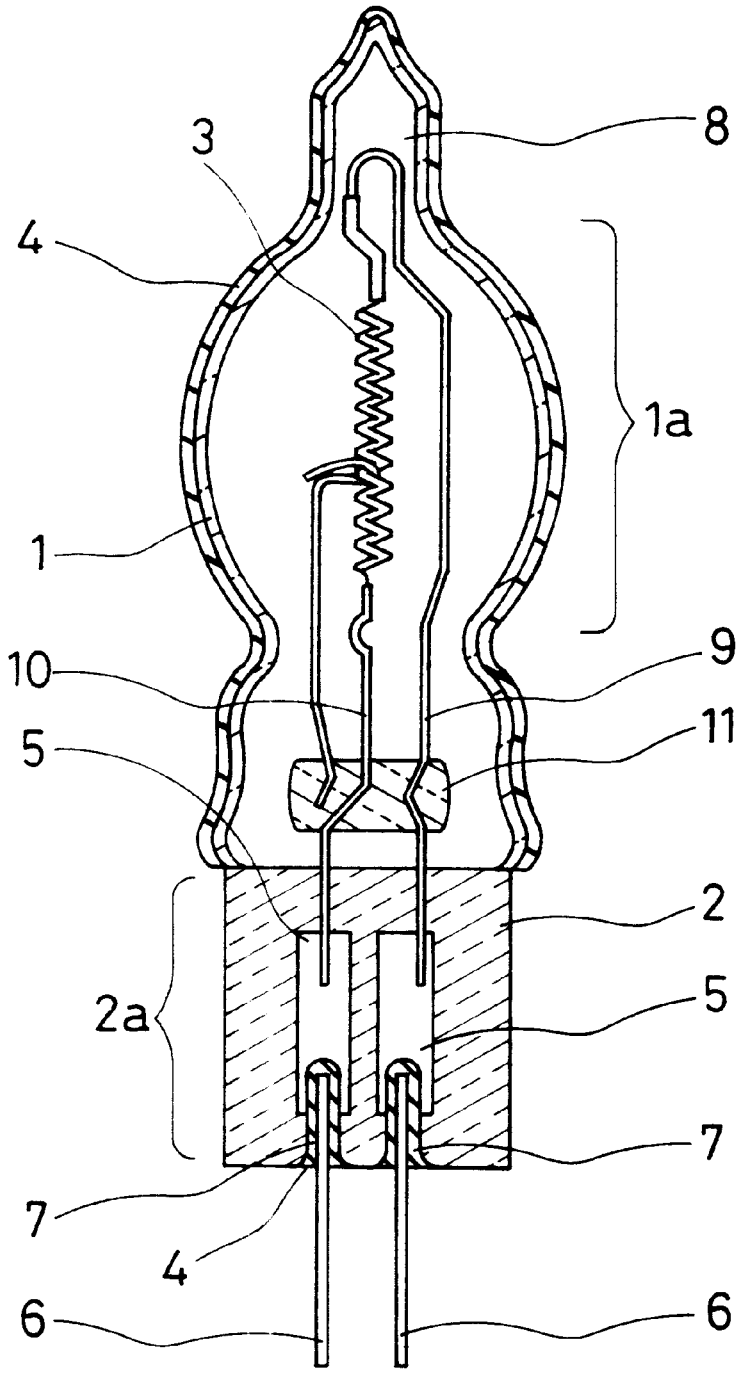
FIG. 2 is a partially cross-sectional view of the tungsten halogen lamp without a base.

FIGS. 1 and 2 show a partially cross-sectional view of a tungsten halogen lamp in an embodiment of the present invention. In the tungsten halogen lamp, a halogen element and a rare gas are enclosed and a filament coil 3 of tungsten having a total length of 10 mm is held. An arc tube 1 is made of fused quartz and has a total length of 44 mm, for example.

The arc tube 1 has an elliptical portion 1*a* having, for example, an outer diameter of 14 mm (an average thickness of about 1 mm) in a main portion to obtain a high efficiency. One end (tip) of the main portion is closed by tipping-off. (Tipping-off is as follows. First, an evacuation pipe is connected to the tip of the main portion, and the pressure inside the arc tube 1 is reduced through the evacuation pipe. Then, the end of the evacuation pipe connected to the tip of the main portion is cut by heating and fusing the end of the evacuation pipe with a burner.) A sealing portion 2 is provided at the other end (root) of the main portion. The filament coil 3 is located inside the main portion of the arc tube 1, that is, the elliptical portion 1*a*, on the central axis of the arc tube 1 and held by inner leads 9 and 10. An infrared reflecting film 4 is formed on the outer surface of the arc tube 1 except for the sealing portion 2. A portion 2*a* where the infrared reflecting film 4 is not formed is defined on the outer surface of the sealing portion 2.

Metal foils 5 of molybdenum to which one end of the inner leads 9 and 10 is connected respectively, and outer leads 6 of molybdenum having one end connected to the metal foils 5 and the other end led out of the sealing portion 2, are crash-sealed in the sealing portion 2. That is, a portion of the arc tube to be formed as the sealing portion is heated, and the softened portion is press-sealed with a die.

In the sealing portion 2, the infrared reflecting film 4 (shown by oblique lines in FIG. 2) is formed on the surfaces of the outer leads 6 and the surfaces of the metal foils 5 exposed to gaps 7 that are not hermetically sealed. The inner leads 9 and 10 are held by a quartz stem glass 11. A base 12 having a ceramic base cap is adhered to the sealing portion 2 with cement.

When the tungsten halogen lamp in this embodiment as shown in FIG. 1 (hereinafter referred to as the article of the present invention) was lighted at a supply voltage of 110 V and a rated input of 90 W, a luminous flux of 2400 lm and a high efficiency of 26.6 lm/W were obtained. A comparative lamp in which the infrared reflecting film 4 was not formed required an input of 150 W to obtain the luminous flux of 2400 lm. Therefore, the article of the present invention showed power savings of 40% compared with the comparative lamp.

In the tungsten halogen lamp in this embodiment, one end (tip) of the arc tube 1 is a tipping-off portion 8 where an evacuation pipe (not shown) is tipped off. In the evacuation process, the inside of the arc tube 1 was evacuated through the evacuation pipe. Then, a predetermined amount of a halide, $CH_2Br_2$, and 0.6 MPa of a mixture of xenon and nitrogen gases were sealed in the arc tube 1, and the evacuation pipe was tipped off. After evacuation, the arc tube 1 was held in a CVD reaction furnace to form the infrared reflecting film 4 comprising 19 layers of $Ta_2O_5$ (9 layers)-$SiO_2$ (10 layers) on the surface of the arc tube 1. The conditions of the CVD technique were as follows.

(1) Temperature:500° C.

(2) Reaction furnace pressure

When the raw material was pentaethoxytantalate ($Ta(OC_2H_5)_5$) and a film to be formed was $Ta_2O_5$: 20 to 60 Pa When the raw material was dibutoxydiacetoxysilane ($(CH_3COO)_2Si[OC(CH_3)_2CH_3]_2$) and a film to be formed was $SiO_2$: 80 to 150 Pa.

The average total thickness of the 19-layer infrared reflecting film erence film) 4 was about 2.2 $\mu$m. The structure of the infrared reflection film (multilayer interference film) is as shown in the following Table 1.

TABLE 1

| Layer No. | Component of the infrared reflecting film | Thickness (nm) |
|---|---|---|
| 1 | $SiO_2$ | 86.2 |
| 2 | $Ta_2O_5$ | 111.1 |
| 3 | $SiO_2$ | 172.4 |
| 4 | $Ta_2O_5$ | 222.2 |
| 5 | $SiO_2$ | 172.4 |
| 6 | $Ta_2O_5$ | 222.2 |
| 7 | $SiO_2$ | 172.4 |
| 8 | $Ta_2O_5$ | 222.2 |
| 9 | $SiO_2$ | 172.4 |
| 10 | $Ta_2O_5$ | 222.2 |
| 11 | $SiO_2$ | 172.4 |
| 12 | $Ta_2O_5$ | 222.2 |
| 13 | $SiO_2$ | 172.4 |
| 14 | $Ta_2O_5$ | 222.2 |
| 15 | $SiO_2$ | 172.4 |
| 16 | $Ta_2O_5$ | 222.2 |
| 17 | $SiO_2$ | 172.4 |
| 18 | $Ta_2O_5$ | 111.1 |
| 19 | $SiO_2$ | 86.2 |

Note: Layer No. shows the order of lamination from the inner layer.

Figure 3:
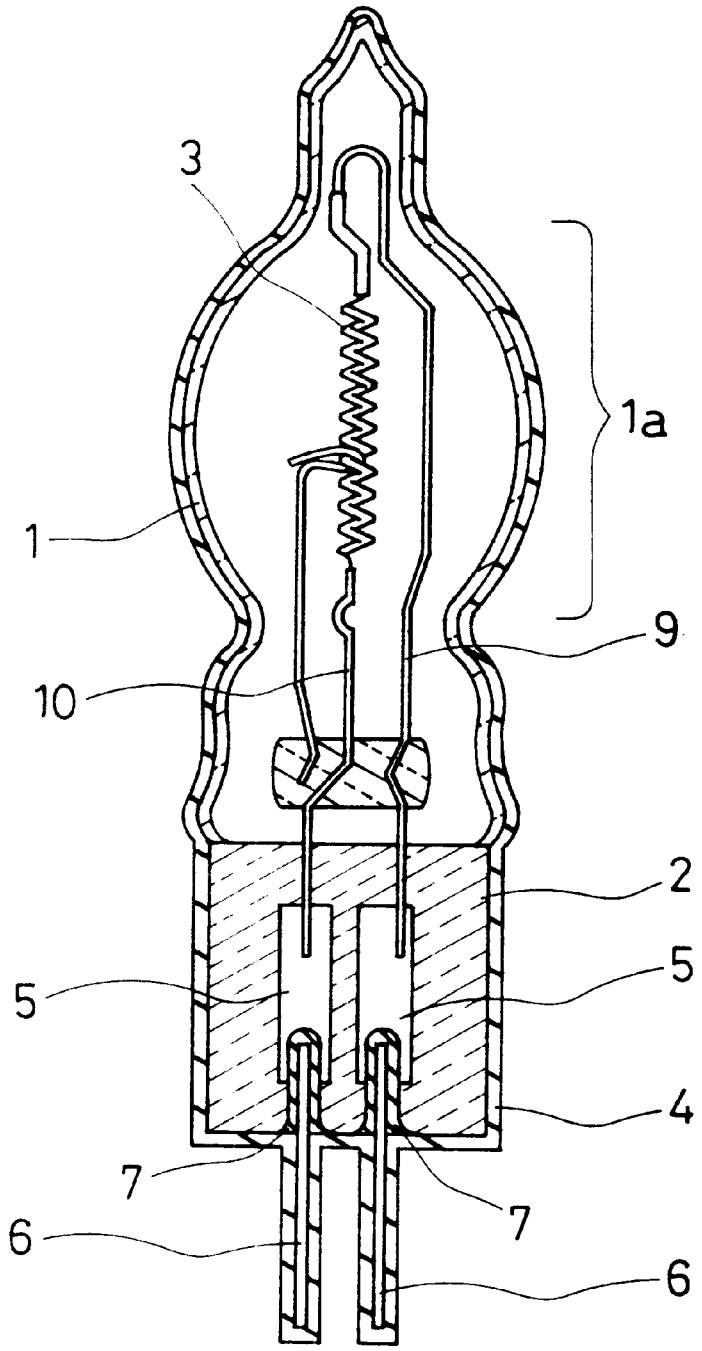
FIG. 3 is a partially cross-sectional view of the tungsten halogen lamp after an infrared reflecting film is formed by a CVD technique.

FIG. 3 shows a partially cross-sectional view of the arc tube 1 after reflecting film 4 is thus formed. sealing portion 2 of the arc tube 1, gaps 7 that are not led occur between the fused quartz of the sealing portion 2 and parts of the metal foils 5 and the outer leads 6, along parts of the metal foils 5, which are sealed together with the inner leads 9 and 10 and the outer leads 6, and along the outer leads 6 connected to the metal foils 5. The gaps occur due to a difference in coefficient of thermal expansion.

When the infrared reflecting film 4 is formed on the surface of the arc tube 1 by the CVD technique, the film 4 enters into the gaps 7 during the CVD process. Thus, the infrared reflecting film 4 is formed on the surfaces of the outer leads 6 and the metal foils 5 in the gaps 7. This is because the CVD process is basically a gas phase reaction so that the reaction gas is diffused or enters into the gaps 7. Also, the infrared reflecting film 4 is formed on the surfaces of the outer leads 6 led out of the sealing portion 2.

The optimum process for forming the infrared reflecting film 4 by the CVD technique is forming the film 4 by holding the arc tube 1 in the CVD reaction furnace after sealing and evacuation. This process is simple and provides high productivity. The infrared reflecting film 4 is always formed on the entire outer surface of the arc tube 1 including the sealing portion 2 when employing the optimum CVD process. In a tungsten halogen lamp in which the infrared reflecting film 4 is formed on the entire surface of the arc tube 1, particularly on the sealing portion 2, if the light is repeatedly turned on and off and the temperature of the sealing portion 2 is higher than 450° C. during lighting, the fused quartz of the arc tube, the metal foils 5, and the outer leads 6 respectively expand and contract, so that the infrared reflecting film 4 formed on the surfaces of the outer leads 6 and the metal foils 5 in the sealing portion 2 cracks. The air reaches the metal foils 5 through the cracks, and therefore the metal foils 5 are oxidized during the lamp life. Eventually, leaks and cracks occur in the sealing portion 2, thereby shortening the lamp life. Such phenomenon easily occurs as the temperature of the sealing portion 2 is higher during lighting.

The tungsten halogen lamp in which the infrared reflecting film 4 is formed over the entire surface of the arc tube 1 including the sealing portion 2 is incorporated into a dichroic reflecting mirror (not shown) to make a tungsten halogen lamp with a reflecting mirror (not shown). As a result of a life test, leaks and cracks occurred in the sealing portion 2 within 1,000 hours with respect to the desired rated life of 2,000 hours, leading to a short life.

As a result of various examination regarding this problem, it was confirmed that the temperature of the sealing portion 2 can be reduced significantly during a rated lighting in a lamp instrument by removing the infrared reflecting film 4 on the sealing portion 2.

Figure 4:
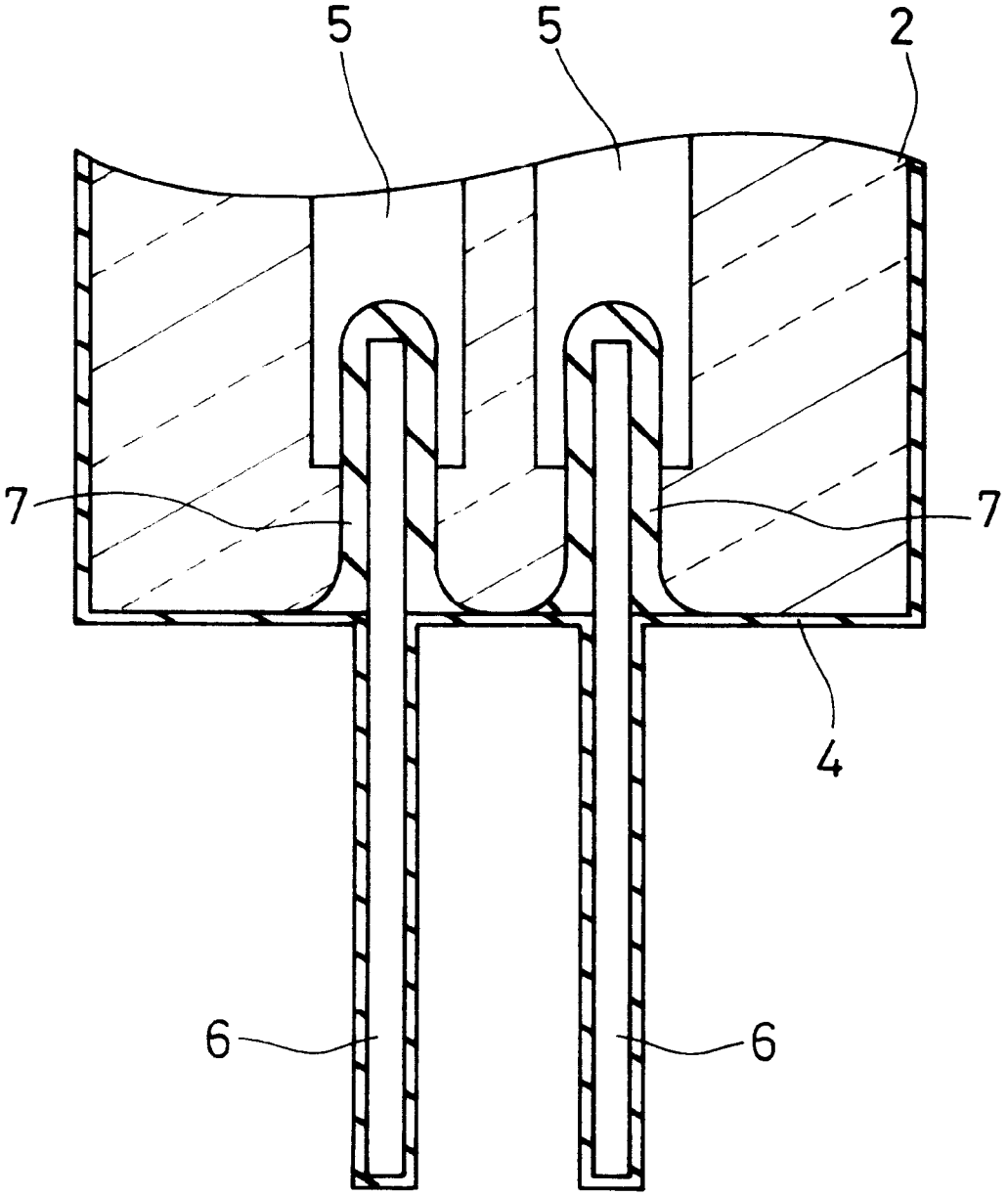
FIG. 4 is an enlarged partially cross-sectional view of the sealing portion of the tungsten halogen lamp.
Figure 5:
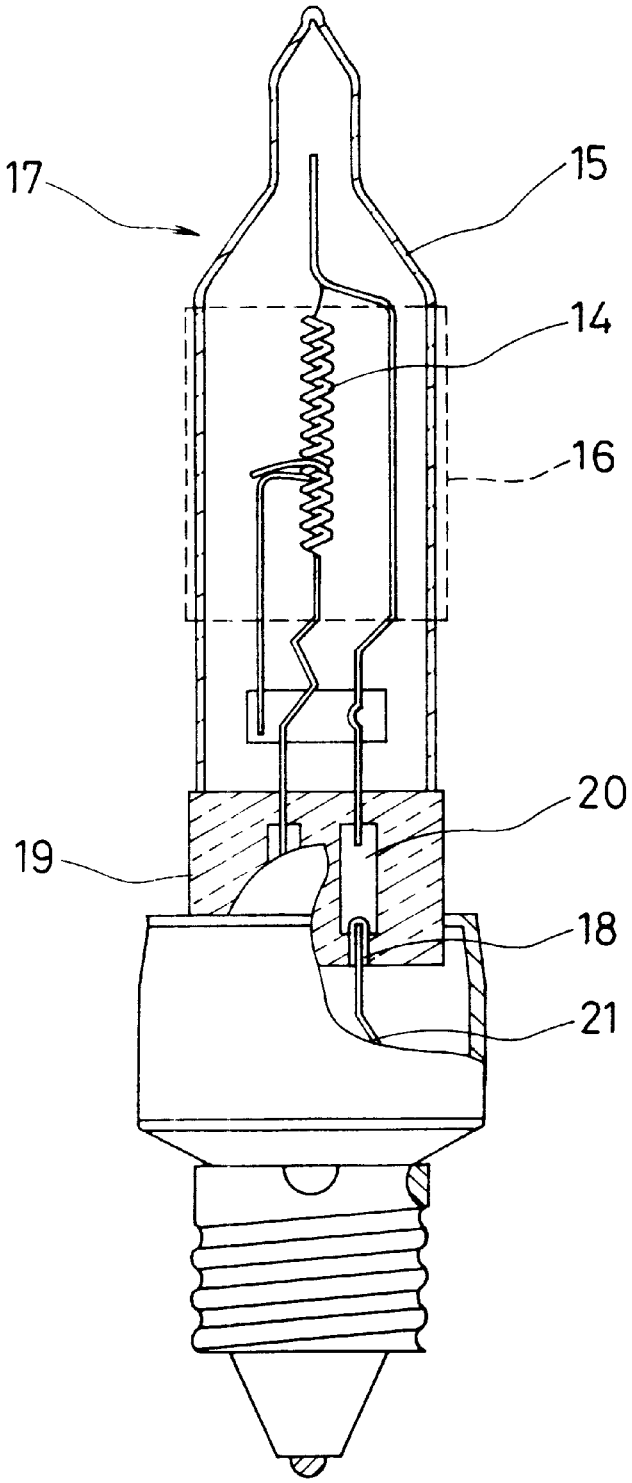
FIG. 5 (PRIOR ART)
FIG. 5 is a partially cross-sectional view of a conventional tungsten halogen lamp.
Figure 6:
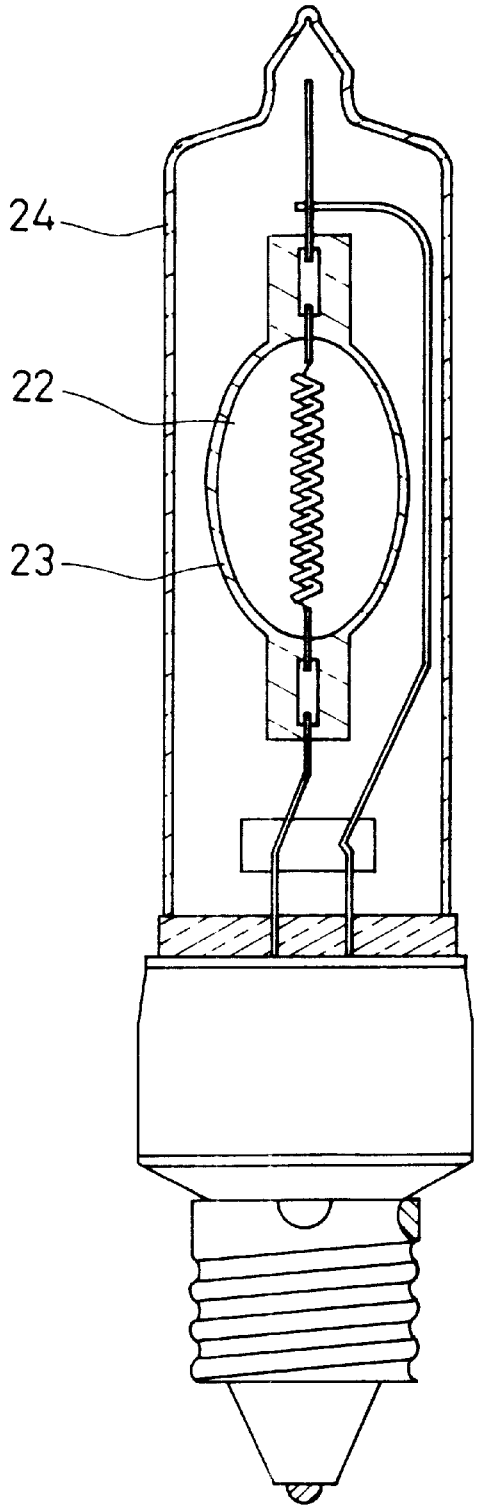
FIG. 6 (PRIOR ART)
FIG. 6 is a partially cross-sectional view of another conventional tungsten halogen lamp.

The temperature of the sealing portion 2 of the tungsten halogen lamp in which the infrared reflecting film 4 was not removed as shown in FIG. 4 was about 460° C. during a rated lighting. The temperature of the sealing portion 2 of the tungsten halogen lamp with a reflecting mirror in which the arc tube 1 without the base 12 according to the present invention as shown in FIG. 2 was incorporated into the above-described reflecting mirror was 345° C. during lighting.

Thus, the life of the lamp can be prolonged to about 2,500 hours, longer than the desired rated life of 2,000 hours, by forming the infrared reflecting film 4 on the surfaces of the outer leads 6 and the metal foils 5 exposed to the gaps 7 in the sealing portion 2 and removing the film 4 formed on the surface of the sealing portion 2 to define the portion 2*a* where the film 4 is not formed on the surface of the sealing portion 2.

It is believed that the infrared reflecting film 4 formed on the surfaces of the outer leads 6 and the metal foils 5 exposed to the air in the gaps 7 protects the outer leads 6 and the metal foils 5 exposed to the air in the gaps 7 by shielding them from the oxygen in the air, thus preventing oxidation.

As a method for manufacturing the article of the present invention, the infrared reflecting film 4 formed on the surface of the sealing portion 2 should be removed after the film 4 is formed on the entire surface of the arc tube 1.

While the CVD technique is used as the method for forming the infrared reflecting film 4 on the surface of the arc tube 1, dipping may be used. In addition, a mechanical method such as sand blasting may be used as the method for removing the infrared reflecting film 4 on the surface of the sealing portion 2. With sand blasting, the film 4 on the surface of the sealing portion 2 is removed and the film 4 in the gaps 7 remains. In this case, the film 4 on the surfaces of the outer leads 6 led out of the sealing portion 2 is removed simultaneously.

In dipping, for example, $[Ti(OC_4H_9)_4]$ was used as the raw material for $TiO_2$ and $[Si(OC_2H_5)_4]$ was used as the raw material for $SiO_2$. The arc tube was dipped in solutions containing these materials, pulled up at a speed of 1 to 5 mm/sec for the coating of a film, and burned at 800° C. More specifically, the arc tube was dipped in a $[Ti(OC_4H_9)_4]$ solution, pulled up, and burned. Then, the arc tube was dipped in a $[Si(OC_2H_5)_4]$ solution, pulled up, and burned. These steps were alternately repeated for the required number of times.

In sand blasting, alumina particles having an average particle diameter of 80 $\mu$m were used as the material for sand blasting. The alumina particles were blown from a nozzle with a high-pressure air and impacted on the sealing portion.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A tungsten halogen lamp comprising:

an arc tube of fused quartz having a sealing portion at one end with a halogen element and a rare gas enclosed and a filament coil held within the arc tube, an infrared reflecting film being formed on a surface of the arc tube, the sealing portion scaling metal foils connected to the filament coil and outer leads having one end connected to the metal foils and the other end led out of the sealing portion, the surfaces of the metal foils being exposed to gaps that are not hermetically sealed by the sealing portion, wherein the infrared reflecting film is formed on surfaces of the outer leads and surfaces of the metal foils, and at least a part defined on the surface of the sealing portion has one selected from the group consisting of a portion where the infrared reflecting film is not formed and a portion where at least a part of the infrared reflecting film is removed.

2. The tungsten halogen lamp according to claim 1, wherein the infrared reflecting film formed on the surface of the arc tube is a multilayer interference film in which layers of a high refractive material and layers of a low refractive material are alternately laminated.

3. The tungsten halogen lamp according to claim 2, wherein the layer of a high refractive material of the infrared reflecting film formed on the surface of the arc tube is made of at least one material selected from the group consisting of $Ta_2O_5$, $Nb_2O_5$, $CeO_2$, SiC, ZnS, $TiO_2$, $Si_3N_4$, $Y_2O_3$, and $ZrO_2$.

4. The tungsten halogen lamp according to claim 2, wherein the layer of a low refractive material of the infrared reflecting film formed on the surface of the arc tube is made of at least one material selected from the group consisting of $MgF_2$, $SiO_2$, and $Al_2O_3$.

5. The tungsten halogen lamp according to claim 1, wherein a total thickness of the infrared reflecting film formed on the surface of the arc tube is in the range of 0.8 to 3.5 $\mu$m.

6. The tungsten halogen lamp according to claim 1, wherein a thickness of the infrared reflecting film formed on the surfaces of the outer leads and the surfaces of the metal foils is in the range of 0.8 to 3.5 $\mu$m.

7. The tungsten halogen lamp according to claim 1, wherein at least a part of the arc tube has a swelling portion, and the filament coil is held on a central axis of the swelling portion.

8. The tungsten halogen lamp according to claim 7, wherein the swelling portion has an elliptical shape.

* * * * *